US006234882B1

(12) United States Patent
Young

(10) Patent No.: US 6,234,882 B1
(45) Date of Patent: May 22, 2001

(54) SURFACE ENHANCEMENT SYSTEM FOR BUILDING BLOCKS

(75) Inventor: Thomas D. Young, Tucson, AZ (US)

(73) Assignee: Advanced Production Manufacturing, Inc., Tucson, AZ (US)

( * ) Notice: Subject to any disclaimer, the term of this patent is extended or adjusted under 35 U.S.C. 154(b) by 0 days.

(21) Appl. No.: 09/317,503

(22) Filed: May 24, 1999

(51) Int. Cl.[7] ..... B24B 7/06

(52) U.S. Cl. ..... 451/260; 451/262; 125/26

(58) Field of Search ..... 451/260, 262, 451/41, 177, 178, 182, 184, 190, 194, 195, 259, 261, 296, 299, 300, 302, 336, 449, 450; 125/26

(56) References Cited

U.S. PATENT DOCUMENTS

| | | | | |
|---|---|---|---|---|
| 1,915,751 | * | 6/1933 | Noble et al. | 125/26 |
| 2,732,590 | * | 1/1956 | Le Clercq | 451/260 |
| 2,884,921 | * | 5/1959 | Drake | 125/26 |
| 2,901,868 | * | 9/1959 | Price et al. | 125/26 |
| 2,958,163 | * | 11/1960 | Cammerzell, Jr. | 125/26 |
| 3,233,369 | * | 2/1966 | Highberg | 451/450 |
| 3,384,065 | * | 5/1968 | Raymond | 125/26 |
| 3,410,259 | * | 11/1968 | Skirvin et al. | 125/26 |
| 3,945,151 | * | 3/1976 | Cook | 125/26 |
| 4,256,078 | * | 3/1981 | Whitty | 125/26 |
| 4,393,856 | * | 7/1983 | Gebhart | 125/26 |
| 4,557,246 | * | 12/1985 | Seeley | 125/26 |
| 5,018,504 | * | 5/1991 | Terbrugge et al. | 125/26 |
| 5,129,190 | * | 7/1992 | Kovach et al. | 451/450 |
| 5,423,717 | * | 6/1995 | Boaz | 451/449 |
| 5,496,206 | * | 3/1996 | Young | 451/260 |

* cited by examiner

*Primary Examiner*—M. Rachuba
(74) *Attorney, Agent, or Firm*—Jones, Day, Reavis & Pogue

(57) ABSTRACT

A system for enhancing the surfaces of building blocks by cutting or grinding away material from the surface to be enhanced. A building block is placed on a conveyer belt which moves the block passed three rotating cutting apparatus each of which is independently powered. Each of the cutting apparatus is independently adjustable in the vertical direction and all three cutting apparatus may be adjusted simultaneously. The system may also be pivoted to allow an enhanced beveled surface to be formed on the building blocks. Also included is a water system for cooling the cutting apparatus and the building block, and an oil system for lubricating the cutting apparatus.

25 Claims, 8 Drawing Sheets

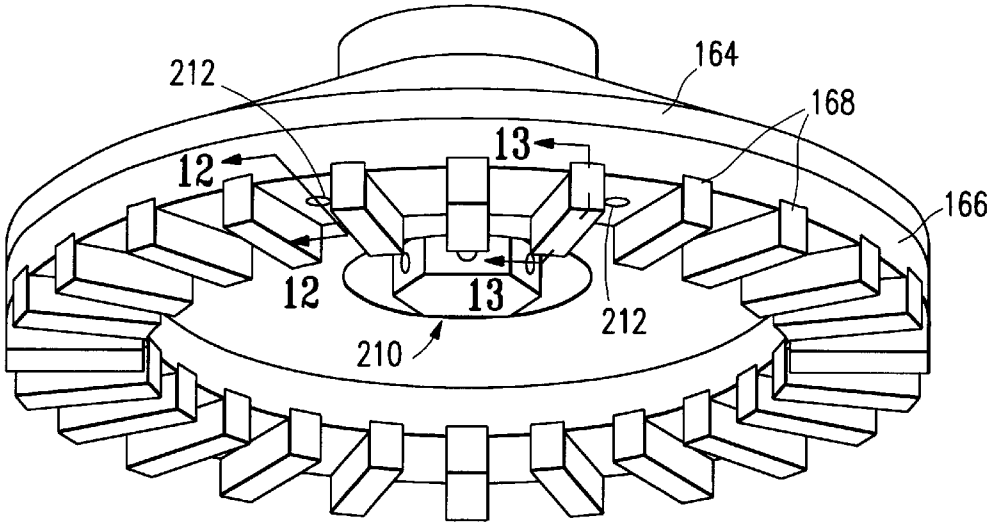
FIG. 11
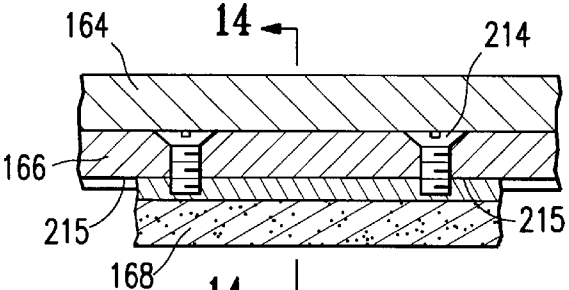
FIG. 14
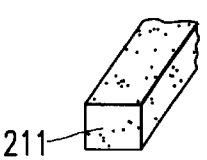
FIG. 15
FIG. 13
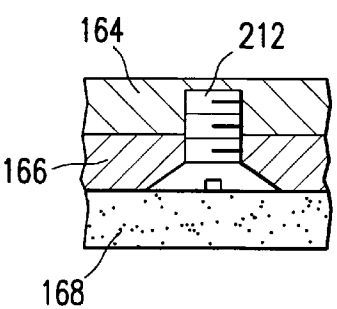
FIG. 12

SURFACE ENHANCEMENT SYSTEM FOR BUILDING BLOCKS

BACKGROUND OF THE INVENTION

1. Field of the Invention

The present invention relates to a system for enhancing the surface of a building block. More particularly the present invention relates to an improvement for cutting material away from the surface of a building block to improve the aesthetic appearance of that surface.

2. Description of the Related Art

The inventor's U.S. Pat. No. 5,496,206, incorporated herein by this reference, discloses an earlier generation of an apparatus for removing a layer of material from a building block to give the block a similarity in appearance to granite and marble.

The present invention is an improvement of the invention disclosed in the above-mentioned patent.

BRIEF SUMMARY OF THE INVENTION

The improved system comprises in combination a conveyer assembly including a conveyer belt to receive and support an object such a building block to be enhanced, a frame assembly including a base frame for supporting the conveyer assembly and a head frame mounted to the base frame, a moveable stage frame supported by the frame assembly, a plurality of moveable mounting platforms supported by the stage frame, a plurality of cutting apparatus each of the cutting apparatus mounted to a platform, a means connected to the stage frame for moving the mounting platforms in relation to the stage frame, and means connected to the frame assembly for moving the stage frame relative to the frame assembly.

An object of the present invention is to provide a surface enhancing system for building blocks which is relatively simple, easy to use, easy to adjust, relatively inexpensive and reliable. Another aspect of the present invention is to provide a surface enhancing system for building blocks which has a relatively long enduring cutting tool and an excellent rate of operation. Another aim of the present invention is to provide a surface enhancing system that can grind a new surface on the block at an oblique angle as so as to provide a "beveled" surface block A more complete understanding of the present invention and its objects, aspects, aims and advantages thereof will be gained from a consideration of the following description of the preferred embodiments read in conjunction with the accompanied drawings provided herein.

BRIEF DESCRIPTION OF THE SEVERAL VIEWS OF THE DRAWINGS

FIG. 11 is bottom perspective view of a cutting disc of the present invention.

FIG. 12 is a partial enlarged side elevational view of a fastener used to mount a cutting ring to the cutting disc taken along line 12—12 of FIG. 11.

FIG. 13 is a partial enlarged side elevational view in section of fasteners connecting a cutting segment to the cutting ring taken along line 13—13 of FIG. 11.

FIG. 14 is a partial enlarged front elevational view of a cutting segment connected to the cutting ring taken along line 14—14 of FIG. 13.

FIG. 15 is a partial enlarged perspective view of a diamond impregnated layer of a cutting segment.

DESCRIPTION OF THE PREFERRED EMBODIMENTS

Figure 1:
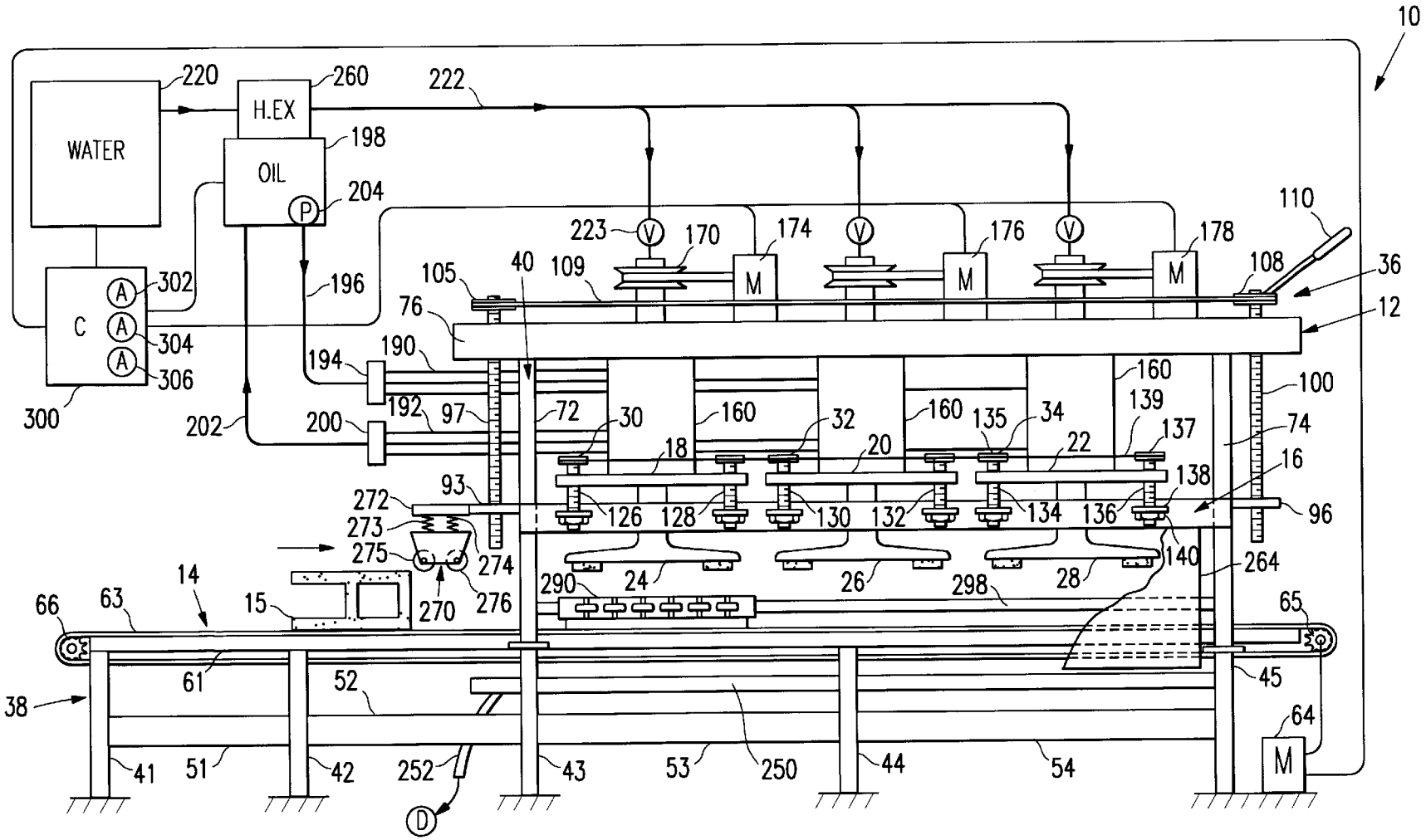
FIG. 1 is a diagrammatic front partial elevational view of a preferred embodiment of the present invention.

While the present invention is open to various modifications and alternative constructions, the preferred embodiments shown in the drawings will be described herein in detail. It is understood, however, that there is no intention to limit the invention to the particular forms disclosed. On the contrary, the intention is to cover all modifications, equivalent structures and methods, and alternative constructions falling within the spirit and scope of the invention as expressed in the appended claims.

Figure 2:
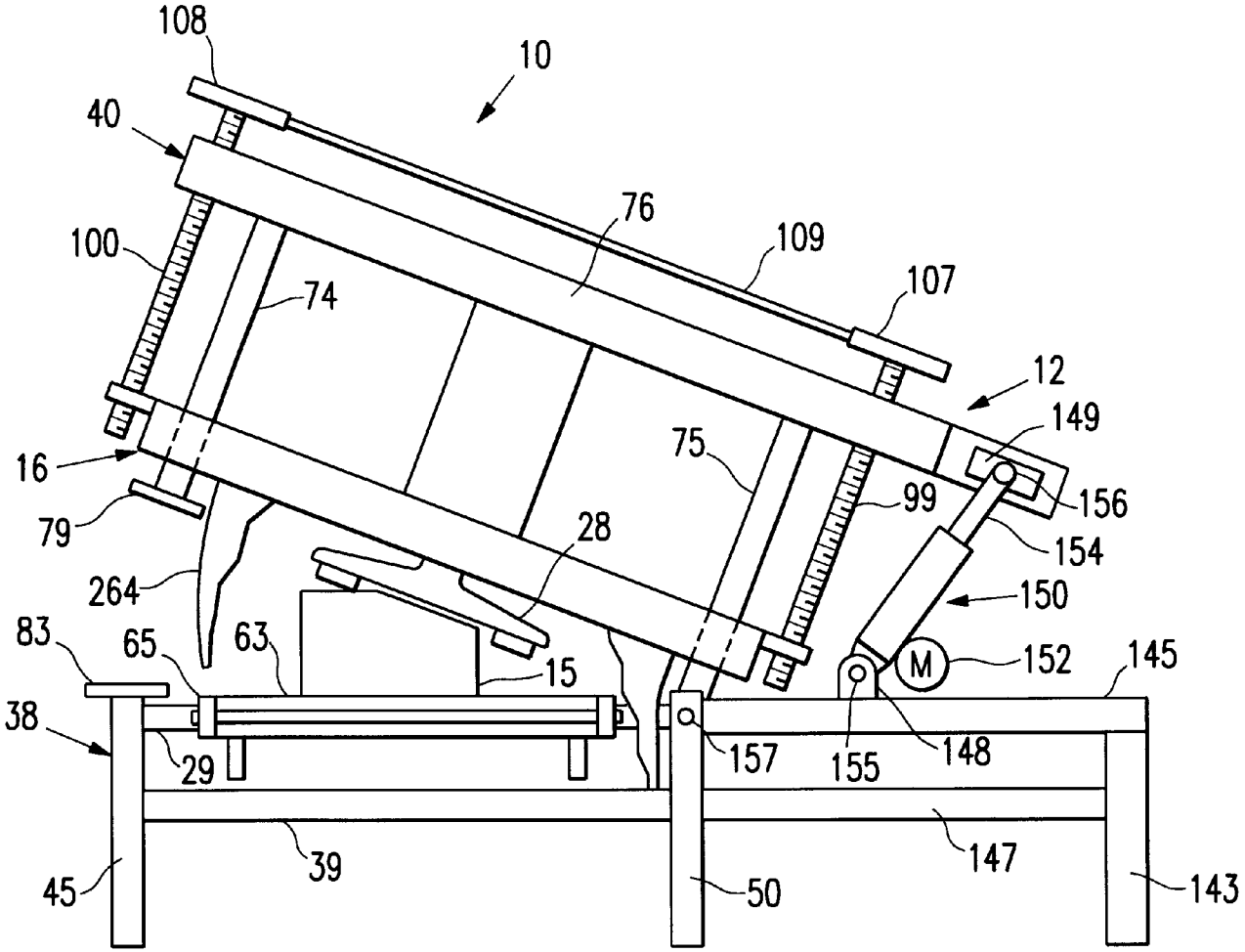
FIG. 2 is a diagrammatic partial side elevational view of the system shown in FIG. 1.

The relatively simple, inexpensive and reliable surface enhancement system can be seen by reference to FIGS. 1 and 2. The surface enhancing system 10 comprises a frame assembly 12, a conveyer assembly 14, a stage frame 16, a plurality of mounting platforms 18, 20 and 22, a plurality of cutting apparatus 24, 26 and 28, means 30, 32 and 34 for moving the mounting platform and means 36 for moving the stage frame. The conveyer assembly transports a block 15 passed the cutting apparatus where material is removed. This removal enhances the appearance of the block.

Figure 3:
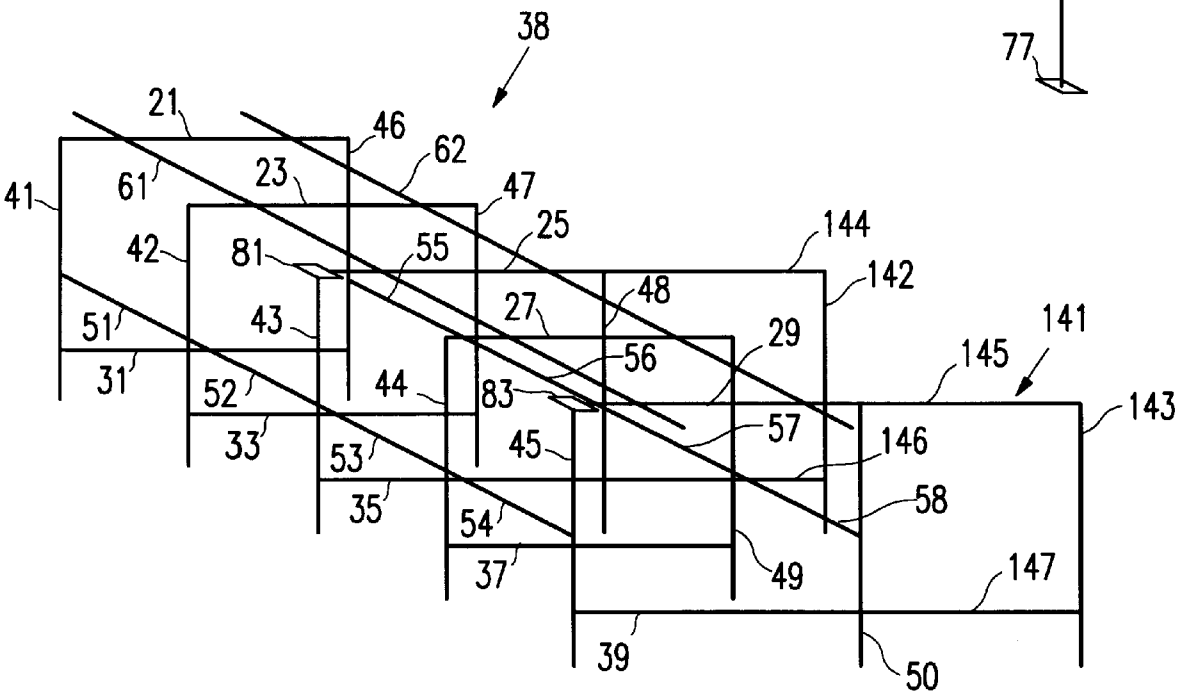
FIG. 3 is a diagrammatic perspective view of a frame assembly of the invention shown in FIGS. 1 and 2.
Figure 6:
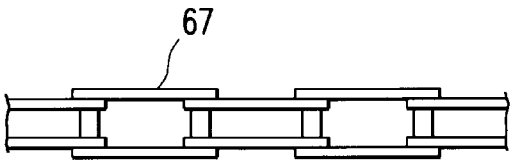
FIG. 6 is a partial plan view of the chain for the conveyer apparatus shown in FIG. 5.
Figure 7:
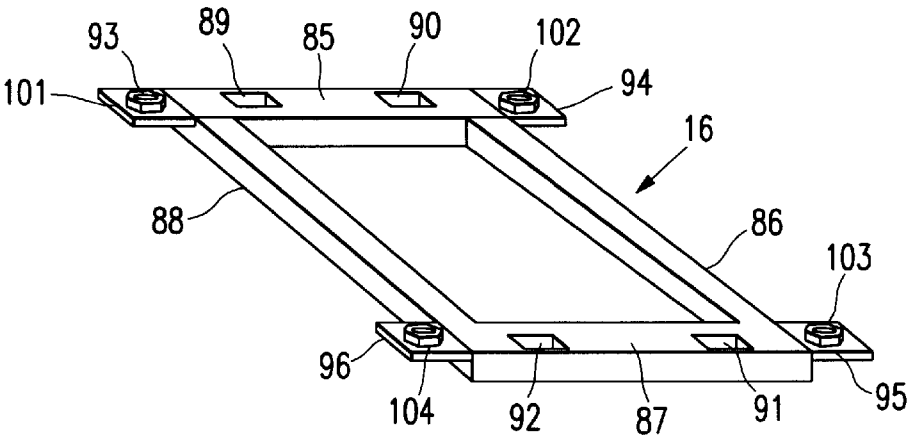
FIG. 7 is a diagrammatic perspective view of a stage frame of the invention shown in FIGS. 1 and 2.
Figure 5:
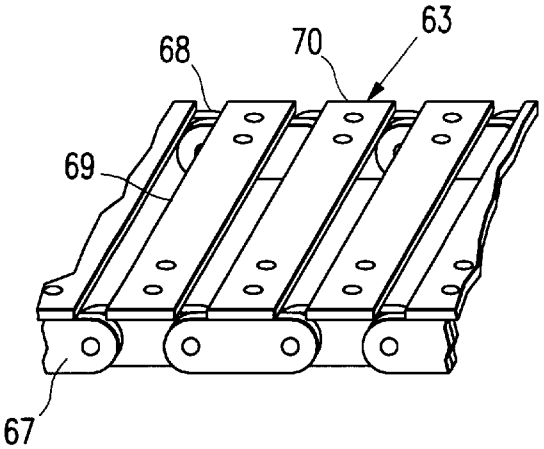
FIG. 5 is an enlarged partial diagrammatic perspective view of a conveyer apparatus of the system shown in FIGS. 1 and 2.

Referring to FIGS. 1, 2 and 3 the frame assembly 12 includes a base frame 38 and a head frame 40. The base frame includes ten vertically disposed legs 41, 42, 43, 44, 45, 46, 47, 48, 49 and 50, five top cross beams, 21, 23, 25, 27, and 29, five bottom cross member 31, 33, 35, 37 and 39 and eight longitudinal beams 51, 52, 53, 54, 55, 56, 57 and 58. The base frame also includes two parallel, horizontally disposed rails 61 and 62 attached to the top cross beams.

Mounted to the base frame 38 is the conveyer assembly 14. Referring now to FIGS. 1, 2, 6 and 7, the conveyer assembly includes a conveyer belt 63 which is propelled by a motor 64 engaging a drive sprocket 65 at the terminal end of the conveyer belt. A follower sprocket 66 is located at the beginning end of the conveyer belt. The conveyer belt includes first and second chain drives 67 and 68. Straddling the two chains are a series of slats, such as the slats 69 and 70. The slats are made of steel and are of sufficient thickness to support the objects to be ground, such as a cinder block 71. The preferred thickness of the slats is 0.75 inches, and the slats are 18 inches long and two inches wide. The chain is of standard construction and may be purchased from a local bearing supply house.

Figure 4:
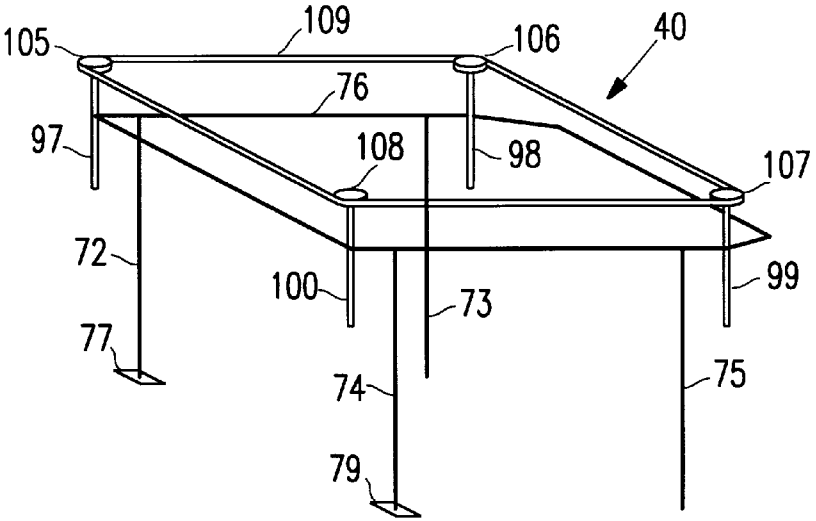
FIG. 4 is a diagrammatic perspective view of a head frame of the invention shown in FIGS. 1 and 2.

Referring to FIGS. 1, 2 and 4 the head frame 40 includes four vertical posts 72, 73, 74 and 75 and a horizontally disposed polygon such as the generally rectangular top frame 76 attached to and supported by the vertical posts. Attached to the posts 72, 74 are foot pads 77, 79 respectively formed from metal plates. These are positioned to engage pads 81, 83 respectively FIG. 3, mounted to the base frame 38.

Referring now to FIGS. 1, 2, 4, 8 and 9 the top frame supports the stage frame 16 and guides the stage frame along the four vertical posts 72, 73, 74 and 75. The stage frame is an assembly of four beams 85, 86, 87 and 88 in a generally rectangular configuration with four corner sleeves 89, 90, 91 and 92 to receive the posts. The vertical beams guide the stage frame in a vertical direction toward and away from the conveyer belt. The stage frame also includes four corner flanges 93, 94, 95 and 96. Attached to the top frame 76 are four rotatable screws 97, 98, 99 and 100. The screws are elongated and extend to the stage frame comer flanges. Attached to each of the stage frame corner flanges are threaded nuts 101, 102, 103 and 104, which engage the screws. The screws are rotatable but are vertically fixed to the top frame. Therefore, rotation of the screws causes the nuts and stage frame to ride vertically upwardly or downwardly depending upon the direction of rotation.

Connected at the upper end of each screw is a drive element, such as the sprockets 105, 106, 107 and 108. The sprockets are connected to each other by a motion transmitting means, such as a chain drive 109. A handle 110 may be attached to one of the sprockets to cause all of the sprockets and the chain to move when the handle is rotated. The relationship of the handle, sprocket, screw, nut, head frame and stage frame are shown best in FIG. 8. A protective sleeve 111 may be positional about each screw to help keep the screw clean. It is to be understood that the stage frame will not move a great distance after initial set up. That is, once grinding begins, the stage frame will be adjusted primarily in response to the wear of the cutting apparatus as will be explained below. Thus, slight movement of the handle is sufficient to adjust the stage frame. The screws, nuts, sprockets, chain, handle and stage frame flanges comprise the means for moving the stage frame relative to the frame assembly.

Referring back to FIG. 1, the three mounting platforms 18, 20 and 22 are mounted to the stage frame. The platforms are plates adjustably supported by the stage frame to be moveable in a vertical direction by means to be described. This is accomplished by rotatable screws, such as the screws 126 and 128 of the platform 18, the screws 130 and 132 of the platform 20, and the screws 134 and 136 of the platform 22. It is understood that two additional screws are mounted to each of the platforms but are not shown. Flanges, such as the flange 138, are attached, usually by welding, to the stage frame and each of these flanges contains a threaded nut, such as the nut 140. Sprockets, such as the sprockets 135 and 137, are fixed at the top of the screws and a drive chain, such as a chain 139, connecting each of the sprockets of a mounting platform, may be used to adjust the platforms upwardly and downwardly. A motor, not shown, may be used to drive each chain or a sprocket, or the sprockets and chain may be manually actuated. As can be appreciated the mounting platform moving means are smaller versions of the stage frame moving means.

Figure 9:
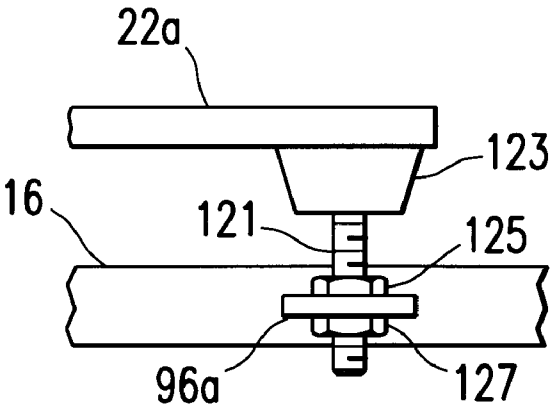
FIG. 9 is a partial side elevational view of one embodiment of means for adjusting the vertical position of mounting platforms of the present invention.
Figure 8:
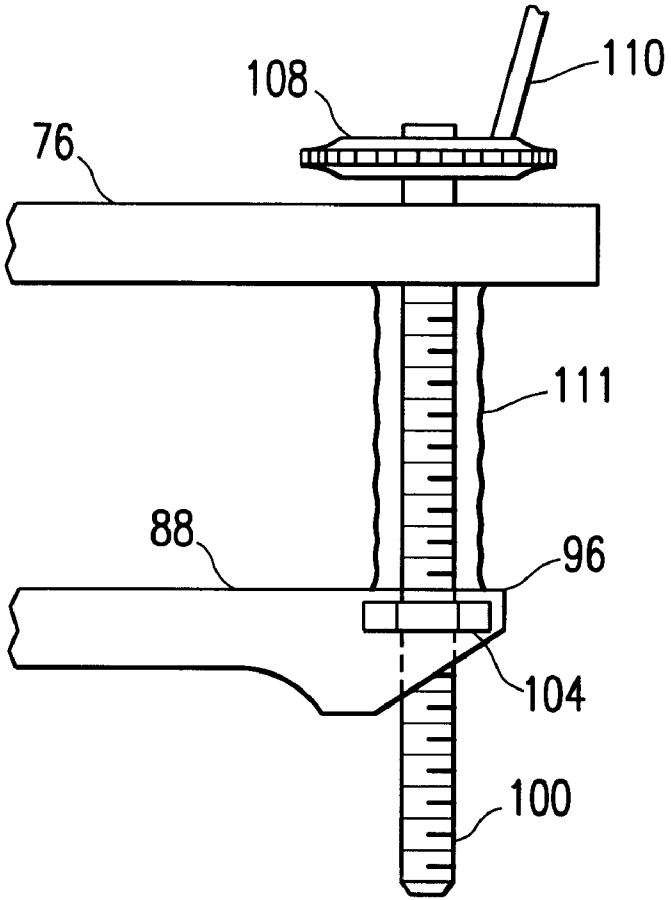
FIG. 8 is a partial side elevational view of the means for adjusting the vertical position of the stage frame shown in FIG. 7.
Figure 10:
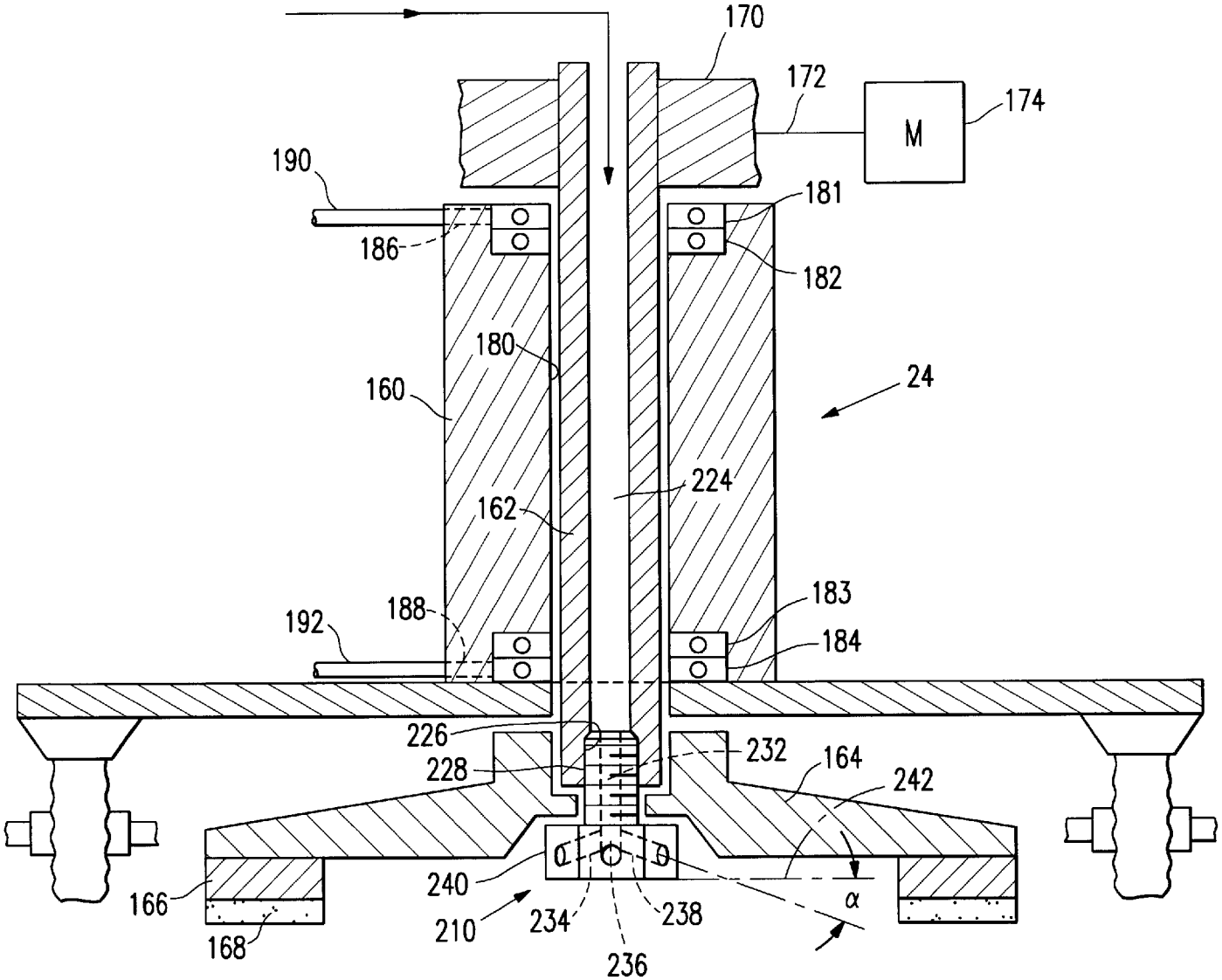
FIG. 10 is an enlarged diagrammatic elevational view of a cutting apparatus, partially in section.
Figure 17:
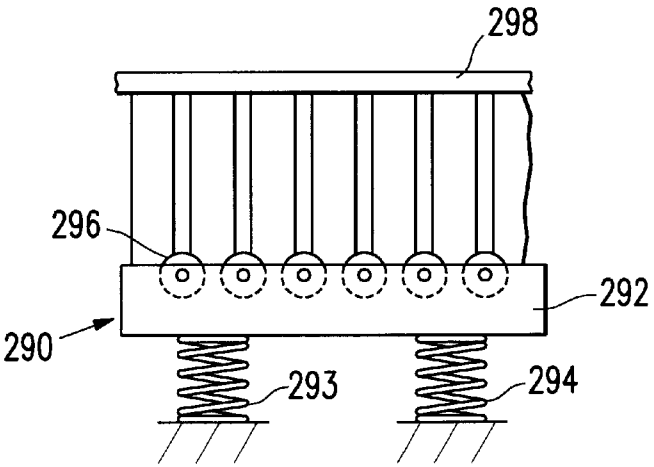
FIG. 17 if a diagrammatic top plan view of a lateral set of biasing wheels.
Figure 16:
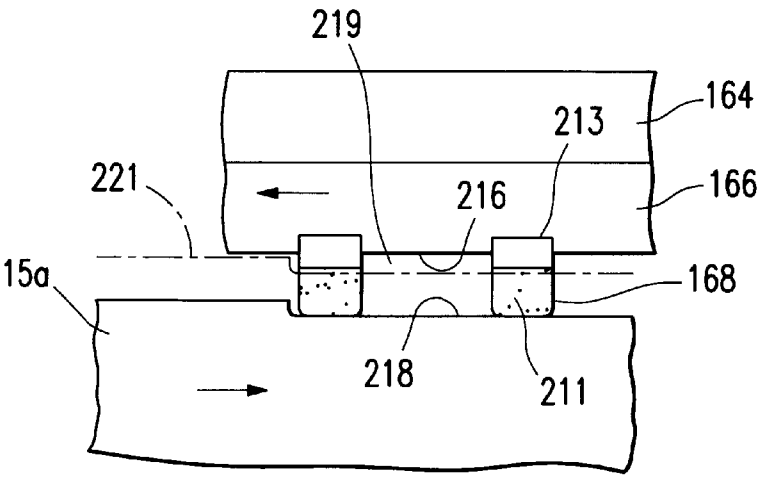
FIG. 16 is a partial enlarged front elevational view of cutting segments removing material from a block.

Referring now to FIG. 9, another embodiment of the mounting platform moving means is shown. The mounting platform 22*a* is connected to a screw 121 by a resilient mount 123. The screw passes through a stage frame flange 96*a*, but instead of being rotatable the screw is fixed. Two nuts, an upper nut 125 and a lower nut 127 are provided to allow vertical adjustment of the platform relative to the stage frame 16. To move downwardly, the lower nut is loosened the distance desired and then the top nut is tightened downwardly. To move upwardly, the top nut is rotated the desired distance and the bottom nut is then tightened.

One of the unique features of the inventive system is that the head frame 40 tilts relative to the base frame 38 as best seen in FIG. 2. This allows beveled surfaces to be formed on the blocks. To support a pivot head frame, a supplemental base frame 141 FIG. 3, is attached to the base frame 38. The supplemental base frame comprises two vertical legs 142, 143, two lateral top extensions 144 and 145 which are continuations of the top cross beams 25 and 29 respectively, and two bottom extensions 146 and 147 which are continuations of the bottom cross beams 35 and 39, respectively.

Mounted to the supplemental base frame and the head frame is a pivoting mechanism 150, FIG. 2. The pivoting mechanism may include a motorized worm 152 and a rotatable screw 154. Welded to the lateral extension 145 is a means for forming a pivot, such as the flange 148, and a similar flange 149 is attached to the top frame. Each flange includes an opening through which a pivot pin, such as the pins 155 and 156, is placed. The upper end of the mechanism has an opening for receiving the pin 156 so as to pivotally attach the pivoting mechanism to the top frame. The mechanism also has an opening to receive the pin 155. When the screw is extended, the head frame sits above the base frame as shown in FIG. 1. However, when the screw 154 is retracted, the right end of the top frame, as seen in FIG. 2, moves downwardly and pivots the head frame in a clockwise direction around another pivot pin 157.

Secured to each of the mounting platforms is a cutting apparatus, such as the cutting apparatus 24, 26 and 28 secured to mounting platforms 18, 20 and 22, respectively. It is understood that additional mounting platforms and cutting apparatus may be arranged on the stage frame should it be desired. This can be easily accomplished by extending the length of the stage frame in the direction of the conveyer belt. Referring to FIGS. 1 and 11, each cutting apparatus, such as the apparatus 24, includes a housing 160, a central shaft 162 mounted within the housing, a disc 164 mounted to the shaft, a cutting ring 166 mounted to the disc, cutting segments 168 mounted to the cutting ring and a drive pulley 170. The pulley is connected by a drive belt 172 to a motor 174. Each of the cutting apparatus is connected to its own motor. Each motor is within the range of 10–12 h.p. The motors 176 and 178 are connected to and drive the cutting apparatus 26 and 28, respectively. Within the housing 160 is a chamber 180. The chamber accommodates the shaft 162 as well as support bearings 181, 182, 183 and 184. To lubricate the bearings and the shaft and to keep the bearings and shaft cool and clean, there is an oil inlet passage 186 and an oil outlet passage 188.

Referring to FIG. 1 again, the oil inlet is attached to a hose 190 and the oil outlet is attached to a hose 192. The hose 190 is connected to a manifold 194 which in turn is connected by a hose 196 to an oil reservoir 198. The outlet hose 192 is connected to a manifold 200 which is connected to the oil reservoir 198 by another hose 202. Each of the other two cutting apparatus are also connected to an oil input hose and an oil output hose. A pump 204 is provided to force the oil to each of the cutting apparatus. Oil is pumped from the reservoir to the manifold and then through the inlet hoses. Oil then bathes the bearings 181, 182 before dropping around the circumference of the shaft 162 to the other bearings 183, 184. Thereafter, the oil exits through the oil outlet, moves through the hose 188 to the manifold 200, and then through the hose 202 back to the reservoir.

Referring now to FIGS. 11–17 the cutting action is accomplished by three main elements, the disc 164, the ring 166 and the cutting segments 168. The disc 164 is mounted to the shaft 162 by a bolt 210. The disc is made of 4130 tool steel and is approximately 10 to 30 inches in diameter. The ring is made of 4140 tool steel or 308 or 316 stainless steel and is approximately three quarters of an inch thick and about three inches wide and has an outer diameter about equal to that of the disc. A preferable diameter is about 18 inches. The ring is connected to the disc by a number of threaded screws, such as the screw 212. The segments are individually mounted to the ring by threaded screws, such as the screw 214. From the foregoing description, it can be seen that the ring may be easily removed and installed and individual cutting segments may also be easily replaced. Should the cutting segments become worn and need replacement a whole ring with its segments can be replaced. If a segment breaks it can individually be replaced easily, quickly and cheaply.

Several advantages are achieved by this relationship. First, the weight of metal being handled by an operator is substantially less than would be the case if the cutting segments were attached directly to the disc as is the case in the prior art. Secondly, it is easier and less time consuming to remove and replace a ring than it would be to replace the entire disc when the segments become worn. Third, individual segments attached to a ring may be replaced relatively easily without the great expense of extensive downtime for the system.

The cutting segments 168 are constructed of diamond impregnated steel, branded BLACKBOND, available from MK Diamond Products of Torrence, Calif. With the construction to be described the diamond impregnated steel may be used more completely than was the case previously. The relatively expensive diamond impregnated steel layer 211 is welded to a relatively inexpensive key stock steel base 213 and the steel base is mounted in recesses, such as the recess 215, in the ring 166. In the past, when the diamond impregnated segments were worn down, there was a need to replace the segments before they became flush with the disc. This was done to prevent damage or wear to the disc or ring and because it was found desirable to have some space between the ring surface 216 and the surface 218 of the block 15*a* being cut to allow the passage of water which is sprayed on the cutting region. Thus, when the segments were wore down sufficiently, but not worn flush with the ring, the segments were replaced. With the new segments disclosed here, the steel base may be dimensioned to leave a region 219 for the passage of water even when the diamond impregnated steel cutting portion has worn down completely. See FIGS. 15 and 17, especially the phantom line 221 representing the cutting surface with worn segments. The segments are spaced between 0.5 to 1.0 inch from each other and there are thirty-two segments per ring. The surface area being ground is about thirty-six square inches. The rotational velocity is within the range of 7500–9000 feet per minute at the rim of each ring, with about 8500 feet per minute being preferred.

The water system for cooling and flushing the cut block material and segment debris may be understood by reference to FIGS. 1 and 11. A water source 220, such as a city water supply at roughly 60 psi, is connected by a suitable hose 222 to each of the vertical shafts of the cutting apparatus through a respective value, such as the value 223. The shaft 162 is elongated and the pulley 170 is attached to the upper end of the shaft, and the cutting disc 164 is attached to the lower end of the shaft. The shaft has a central opening 224 which forms a water passageway. The shaft is of stainless steel having a two and three-quarter inch diameter and the central opening is five-eighths of an inch in diameter. At the lower end of the shaft, there are internal screw threads 226 which receives a threaded stem 228 of the bolt 210. The stem 228 includes a water passageway 232. At one end of the passageway 232 there is communication with the central passageway 224 of the shaft. The other end of the stem communicates with laterally directed water passages, such as passages 234, 236 and 238 in the head 240 of the bolt. There are six lateral passages, and each of these passages exit at one of the six faces of the bolt.

The bolt head passages are disposed at a downward angle so as to spray water at the region of contact between the cutting segments and the block surface. The downward angle of the lateral passages are from about 12° to about 20° from a horizontal reference plane symbolized by the phantom line 242. The water introduced to the vertical shaft flows down the center passageway and is sprayed by the rotating bolt head 240 on the surface being worked. This cools the cutting segments and the block surface and washes away debris. The water drips into a pan 250 beneath the conveyer belt and supported by the base frame. The pan is tilted to direct the water to a down spout 252 and from there to a drain 254.

The water system does double duty by also cooling the lubricating oil used to lubricate the cutting apparatus. Before entering the housing shafts of the cutting apparatus, the water flows through a heat exchange 260. The oil also circulates through the heat exchanger.

A flexible water repellent curtain 264, partially shown in FIGS. 1, hangs from the stage frame to a vertical height below the water pan to direct any splashing water downwardly to the pan. A similar curtain hangs parallel to the curtain 264 on the other side of the conveyer belt. Two more curtains with cutouts for the blocks moving on the conveyer belt are attached to the stage frame laterally between the parallel curtains so as to enclose the cutting discs. The lateral curtains are placed at the entry and exit to the cutting apparatus.

Referring again to FIG. 1, attached to the front end of the stage frame is a biasing element 270 comprising a mounting flange 272, springs 273, 274 and rollers 275, 276. The biasing assembly insures that the blocks being transported on the conveyer belt are properly located vertically and that the conveyer belt itself is flat and without kinks. A lateral set of biasing wheels 290 is also provided. This set is needed primarily for blocks on which bevel cuts are being made. The set comprises a mounting flange 292, FIG. 18, mounted to biasing springs 293, 294, which in turn are attached to the base frame. Mounted to the flange 292 are a series of rollers, such as the roller 296, which are designed to engage the lateral side of blocks being moved along by the conveyer belt to correctly position the blocks for grinding. A low friction railing 298 is attached to the base frame opposite the biasing wheels so that the blocks to be ground are aligned against the railings, and between the railing and the wheels.

A control system 300 is electrically connected in any suitable way to the oil pump 204, to the conveyer assembly motor 64, to the motors 174, 176 and 178 which operate the cutting discs, and to the motors, one of which being shown in FIG. 2, that cause the head frame 40 to pivot relative to the base frame 38. The control system also includes three amp meters 302, 304, 306 which are operably connected to the three cutting apparatus motors 174, 176 and 178. This allows an operator to monitor in real time the power usage of each of the motors to ensure that they are approximately equal to one another. Each amp meter indicates the depth of cut of its respective cutting apparatus. Hence, an increase in amperage to one of the motors is an indication of an imbalance between the cutting apparatus and a warning that corrective measures ought to be taken. Either the one cutting apparatus needs to cut less material or the other apparatus need to cut more.

In operation, the surface enhancement system 10 is easy to use, is relatively economical and commerically reliable. Generally, an operator adjusts the vertical location of the stage frame and the vertical locations of each of the mounting platforms. These adjustments will determine the depth of cut of each of the cutting apparatus. The water source is turned on and the oil pump is activated. The block to be enhanced is placed on the conveyer belt and the motor activating the conveyer belt is energized, as are the cutting apparatus motors. As the block is moved toward the cutting apparatus, the biasing element presses downwardly on the block to ensure firm seating on the conveyer belt and to ensure that no kinks are in the conveyer belt portion supporting the block. The block also is engaged by the lateral biasing wheels to force the block against the low friction railing. The block then passes the three cutters in sequence. At each cutter material is progressively removed from the block. During this time, water flushes the block surface being cut to carry away debris to the pan. In addition, the water cools the cutting segments and the surface of the block being ground. At the same time, oil is circulating through the cutting apparatus to lubricate the bearings and shaft and cool the cutting apparatus. Thereafter, the block emerges from under the stage platform and is stacked for shipment. It has been found that a reasonable rate of production is twelve blocks per minute. The system may operate as high as twenty blocks per minute, but then there is a labor problem of loading and unloading the blocks. If labor expense was not a factor, the system may operate at twenty blocks per minute or even higher.

The specification describes in detail two embodiments of the present invention. Other modifications and variations will, under the doctrine of equivalents, come within the scope of the appended claims. For example, a system having more or less cutting apparatus and mounting platforms, or having these cutting apparatus aligned in parallel rolls over a wider conveyer apparatus are considered equivalent structures. Also, a geometrically modified base frame, stage frame and/or head frame are considered equivalent structures. Still other alternatives will also be equivalent as will many new technologies. There is no desire or attention here to limit in any way the application of the doctrine of equivalents.

What is claimed is:

1. A surface enhancing system comprising in combination:

a base frame;

a conveyor assembly mounted to said base frame to receive, support and move an object having a surface to be enhanced;

a plurality of adjustable mounting platforms;

a plurality of cutting apparatus, each of said cutting apparatus mounted to a corresponding one of said plurality of mounting platforms wherein each cutting apparatus is individually adjustable relative to said conveyor assembly;

an adjustable stage frame connected to each of said plurality of platforms for simultaneously adjusting all of the plurality of cutting apparatus; and a head frame for supporting said stage frame, said plurality of platforms and said plurality of cutting apparatus, said head frame being pivotally mounted to said base frame for positioning said plurality of cutting apparatus to cut bevel surfaces on said object moving on said conveyor.

2. A system as claimed in claim 1 including:

means for forming a pivot connected to said base frame;

means for forming a pivot connected to said head frame;

means connected to each of said pivot forming means for altering the distance between the two pivot forming means.

3. A system as claimed in claim 2 wherein:

said distance altering means is a worm and screw device.

4. A system as claimed in claim 1 wherein:

each cutting apparatus includes a rotatable shaft, means for mounting said shaft, a disc removably connected to said shaft, a ring removably mounted to said disc and a plurality of cutting segments removably mounted to said ring.

5. A system as claimed in claim 4 including:

a water delivery system comprising a conduit for connecting a water source to each of said rotatable shafts, each of said rotatable shafts having a longitudinally disposed water passageway; and a plurality of bolts, each bolt for attaching a disc to a rotatable shaft, each of said bolts having a stem with a longitudinally disposed water passageway and a head with a plurality of generally radially directed water passageways, wherein said shaft passageways, said stem passageways, and said head passageways combining to pass water from said water source to the cutting segments and the object being enhanced.

6. A system as claimed in claim 5 wherein:

said means for mounting said shaft includes a housing, a bearing mounted to said housing, said bearing for supporting said rotatable shaft, and a chamber within said housing in communication with said bearing; and including an oil inlet passageway in each of said housings in communication with a respective chamber;

an oil outlet passageway in each of said housings in communication with a respective chamber;

an oil reservoir operatively connected to all of said oil inlet and said oil outlet passageways;

a first conduit connected to said oil reservoir and said oil inlet passageways; and a second conduit connected to said oil reservoir and said oil outlet passageways.

7. A system is claimed in claim 6 including:

a plurality of bolts, each of said bolts connecting a disc to a shaft and wherein:

said ring is mounted to said disc by threaded fasteners;

said cutting segments are mounted to said ring by threaded fasteners;

said cutting segments are each comprised of a layer of steel and a layer of diamond impregnated material;

said diamond impregnated material is welded to said layer of steel;

said cutting segments are mounted in recesses in said ring; and the height of said layer of steel is greater than the depth of said recesses.

8. A system as claimed in claim 1 wherein:

said head frame is rotatable about an axis parallel to a longitudinal axis of said conveyor assembly.

9. A system as claimed in claim 1 wherein:

each of said plurality of cutting apparatus includes cutting means rotatable in one or more parallel planes, said planes being movable by said head frame between a position parallel to said conveyor assembly and a position at an angle to said conveyor assembly.

10. A system as claimed in claim 1 including:

a plurality of threaded nuts connected to said stage frame;

a plurality of rotatable threaded shafts, each shaft having an upper portion mounted to said head frame and a lower portion engaging one of said plurality of threaded nuts;

a plurality of drive elements, each drive element connected to an upper end of a respective shaft;

a motion transmitting means operatively engaged to all of said drive elements for rotating each of said elements an equal distance simultaneously; and means operatively engaged to said motion transmitting means for causing said motion transmitting means to move.

11. A system as claimed in claim 10 wherein:

said drive elements are sprockets; and said motion transmitting means is a chain.

12. A system as claimed in claim 1 wherein:

each of said mounting platforms comprises a plate and each plate is independently movable relative to said stage frame.

13. A system as claimed in claim 12 wherein:

said means for moving said mounting platforms includes a plurality of threaded nuts connected to said stage frame, a plurality of threaded shafts connected to said mounting platforms and said stage frame, and a plurality of resilient mounting members connected to each of said mounting platforms.

14. A system as claimed in claim 13 wherein:

each of said mounting platforms is operatively connected to four nuts, four threaded shafts and four resilient mounting members.

15. A system as claimed in claim 1 wherein:

said conveyer assembly includes two chains disposed in parallel and a plurality of slats, each slat straddling said two chains;

said base frame includes a plurality of legs and two rails disposed in generally parallel horizontal alignment, said rails for supporting said chains of said conveyer assembly; and said base frame also including additional legs for supporting said head frame in a pivotal relationship relative to said base frame.

16. A system as claimed in claim 1 wherein:

each cutting apparatus includes a rotatable shaft, means for mounting such shaft, a disc removably connected to said shaft, a ring removably mounted to said disc and a plurality of cutting segments removably mounted to said ring.

17. A system as claimed in claim 16 wherein:

said cutting apparatus includes:

a housing for receiving said rotatable shaft;

bearings for mounting said shaft to said housing; and a bolt connecting said disc to said shaft.

18. A system as claimed in claim 17 wherein:

said ring is mounted to said disc by threaded fasteners; and said cutting segments are mounted to said ring by threaded fasteners.

19. A system as claimed in claim 18 wherein:

said cutting segments are each comprised of a layer of steel and a layer of diamond impregnated material; and said diamond impregnated material is welded to said layer of steel.

20. A system as claimed in claim 19 wherein:

said cutting segments are mounted in recesses in said rings; and the height of said layer of steel is greater than the depth of said recesses.

21. A system as claimed in claim 16 wherein:

each of said cutting apparatus also includes a motor mounted to said head frame; and means for transmitting rotational motion from said motor to said rotatable shaft.

22. A system as claimed in claim 5 wherein:

said head passageways are disposed at a downward angle in a range between about 12 and 20 degrees from a horizontal reference plane.

23. A system as claimed in claim 22 wherein:

each of said bolt heads has six faces and each face has a terminal opening for a respective radial water passageway.

24. A system as claimed in claim 16 wherein:

said means for mounting said shaft includes a housing, a bearing mounted to said housing, said bearing for supporting said rotatable shaft, and a chamber within said housing in communication with said bearing; and including:

an oil inlet passageway in said housing in communication with said chamber;

an oil outlet passageway in said housing in communication with said chamber;

an oil reservoir operatively connected to said oil inlet and said oil outlet passageways;

a first conduit connected to said oil reservoir and to said oil inlet passageway; and a second conduit connected to said oil reservoir and to said oil outlet passageway.

25. A system as claimed in claim 24 including:

a heat exchanger operatively connected to said oil reservoir; and a water delivery system for transferring water from a water source to said heat exchanger and from said heat exchanger to said cutting segments.

* * * * *